US009970605B2

(12) United States Patent
Owada

(10) Patent No.: US 9,970,605 B2
(45) Date of Patent: May 15, 2018

(54) SEMICONDUCTOR LIGHT SOURCE APPARATUS

(71) Applicant: Stanley Electric Co., Ltd., Tokyo (JP)

(72) Inventor: Soji Owada, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 366 days.

(21) Appl. No.: 14/943,240

(22) Filed: Nov. 17, 2015

(65) Prior Publication Data

US 2016/0138766 A1 May 19, 2016

(30) Foreign Application Priority Data

Nov. 18, 2014 (JP) ..... 2014-233790

(51) Int. Cl.

| | |
|---|---|
| ***F21V 9/16*** | (2006.01) |
| ***F21K 99/00*** | (2016.01) |
| ***F21V 29/505*** | (2015.01) |
| ***F21K 9/64*** | (2016.01) |
| *F21Y 115/30* | (2016.01) |
| *F21Y 115/10* | (2016.01) |

(52) U.S. Cl.

CPC ..... *F21K 9/56* (2013.01); *F21K 9/64* (2016.08); *F21V 29/505* (2015.01); *F21Y 2115/10* (2016.08); *F21Y 2115/30* (2016.08)

(58) Field of Classification Search

CPC ..... F21K 9/56; F21K 9/64; F21K 9/00; F21K 2/00; F21V 29/505; F21V 13/02; F21V 13/08; F21V 9/00; F21V 9/16; F21Y 2115/30; F21Y 2115/10

USPC ..... 362/84

See application file for complete search history.

(56) References Cited

U.S. PATENT DOCUMENTS

| | | | | |
|---|---|---|---|---|
| 8,556,437 | B2 | 10/2013 | Miyake | |
| 2011/0149549 | A1* | 6/2011 | Miyake | F21V 7/22 362/84 |
| 2014/0233210 | A1* | 8/2014 | Owada | F21V 29/505 362/84 |
| 2016/0091712 | A1* | 3/2016 | Egawa | G03B 21/204 353/31 |

(Continued)

FOREIGN PATENT DOCUMENTS

| | | | |
|---|---|---|---|
| JP | 2012-64484 | A | 3/2012 |
| JP | 2013-130605 | A | 7/2013 |

*Primary Examiner* — Anh Mai
*Assistant Examiner* — Glenn Zimmerman
(74) *Attorney, Agent, or Firm* — Kenealy Vaidya LLP

(57) ABSTRACT

A reliable reflective typed semiconductor light source apparatus can emit various color lights having high brightness. The apparatus can include a first and second reflector layer, a phosphor plate disposed on the first reflector layer and a semiconductor light source. The phosphor plate can include at least one of at least one of a red phosphor, a green phosphor, a blue phosphor and a yellow phosphor. The light source can be located adjacent the phosphor plate so that an excited light emitted from the light source can be efficiently reflected on the first reflector layer via the phosphor plate and so that heats generated from the first reflector layer and the like can efficiently transmit toward the second reflector layer. Thus, the disclosed subject matter can provide a semiconductor light source apparatus that can emit various color lights having high brightness, and which can be used for general lighting, etc.

10 Claims, 11 Drawing Sheets

(56) References Cited

U.S. PATENT DOCUMENTS

| | | | | |
|---|---|---|---|---|
| 2016/0138766 | A1* | 5/2016 | Owada | F21K 9/64<br>362/84 |
| 2017/0293211 | A1* | 10/2017 | Kobayashi | G03B 21/16 |

* cited by examiner

SEMICONDUCTOR LIGHT SOURCE APPARATUS

This application claims the priority benefit under 35 U.S.C. § 119 of Japanese Patent Application No. 2014-233790 filed on Nov. 18, 2014, which is hereby incorporated in its entirety by reference.

BACKGROUND

1. Field

The presently disclosed subject matter relates to reliable semiconductor light source apparatuses, and more particularly to reliable reflective typed semiconductor light source apparatuses having a phosphor plate and two reflector layers, which can prevent a degradation of optical characteristics caused by heats generated from the phosphor pale and a first reflector layer and can efficiently radiate the heats using a second reflector layer and the like, and which can also emit various color lights having a large amount of light intensity including a substantially white color tone in order to be able to be used for general lighting, a stage light, a street light, a projector, etc.

2. Description of the Related Art

A range of application for semiconductor light source apparatuses, which may emit various color lights by combining a wavelength-converting material such as a phosphor layer with a semiconductor light-emitting device such as an LED, have expanded to various fields such as vehicle lamps, general lighting, street lighting, etc. because brightness of the semiconductor light source apparatuses have improved. As a method for such the semiconductor light source apparatuses, a transmission type, which emits a mixture light having a color tone from a light-emitting surface of the phosphor layer by entering an exciting light into the phosphor layer from an incident surface located opposite the light-emitting surface, is well known.

As another method, a reflective type, which emits a mixture light having a color tone from a light-emitting surface of a phosphor plate including a reflector surface by entering an exciting light into the phosphor plate from an incident surface located on the same reflector surface and by reflecting the mixture light with the reflector surface, is well known. The reflective type may emit the mixture light having a high light-intensity mainly by using the mixture light reflected from the reflector surface, and therefore has been expected to expand in application.

FIG. 11 is a schematic structural view showing a first conventional semiconductor light source apparatus of the reflective type disclosed in Patent document No. 1 (Japanese Patent Application Laid Open JP2012-64484), and a conventional light source apparatus similar to the first conventional semiconductor light source apparatus is also disclosed Patent document No. 2 (U.S. Pat. No. 8,556,437). The patent documents No. 1 and No. 2 are disclosed by a same inventor, and are owned by Applicant of this disclosed subject matter.

The first conventional semiconductor light source apparatus includes: a reflector 84; a phosphor ceramic 83 arranged on the reflector 84 via a transparent adhesive material 85; a semiconductor light-emitting device 81 having an optical axis 82 located adjacent the phosphor ceramic 83, the optical axis 82 intersecting with the phosphor ceramic 83; a mixture light 86 having a color tone emitted from a light-emitting surface of the phosphor ceramic 83 by entering an exciting light emitted from the semiconductor light-emitting device 81 into the phosphor ceramic 83 and by reflecting the mixture light using at least one of the reflector 84, the transparent adhesive material 85 and the phosphor ceramic 83; and an optical lens 87 located in a direction of the light-emitting surface of the phosphor ceramic 83, and projecting a prescribed light distribution pattern using the mixture light 86.

In the first conventional semiconductor light source apparatus 80, a heat generated from the phosphor ceramic 83 by the excited light emitted from the semiconductor light-emitting device 81 may mainly radiate from the reflector 84, which is made from a metallic plate, and therefore may not degrade the phosphor ceramic 83. However, because the heat generated from the phosphor ceramic 83 may degrade the transparent adhesive material 85, an adhesive intensity between the phosphor ceramic 83 and the reflector 84 may degrade and a reflectivity of the reflector 84 may decrease. Hence, the heat generated from the phosphor ceramic 83 may cause optical characteristics of the semiconductor light source apparatus 80 to gradually deteriorate.

A second conventional semiconductor light source apparatus, in which each of marks 85 and 84 shown in FIG. 11 is respectively replaced with a reflector layer that is directly formed underneath the phosphor plate (83) and a heat sink made from a metallic material such as aluminum and the like, is disclosed in Patent document No. 3 (Japanese Patent Application Laid Open JP2013-130605). The second conventional light source apparatus does not include the transparent adhesive material 85 shown in FIG. 11, and therefore may prevent the above-described degradation of the optical characteristics thereof, which is caused by the transparent adhesive material.

However, although a reflection ratio of the reflector layer such as silver (Ag) and the like may be approximately 90 percentages or more, light absorbed into the reflector layer without a reflection may vary a heat. For example, when the excited light having a density of 30 $W/mm^2$ enters into the reflector layer with a reflection ratio of 97 percentages, the light of 3 percentages absorbed into the reflector layer may vary a heat having a heating density of 0.9 $W/mm^2$.

In addition, when the excited light entering into the phosphor plate is wavelength-converted by a phosphor contained in the phosphor plate, the phosphor plate may develop a heat. The phosphor plate may generally include a transparent resin such as a silicone resin and the like to contain the phosphor therein, and a part of the transparent resin having a relatively low thermal conductivity may contact with the reflector layer. Accordingly, the above-described heats generated from the phosphor plate and absorbed into the reflector layer may degrade the transparent resin, and therefore may cause a degradation of optical characteristics of the second conventional semiconductor light source apparatus in common with the first conventional semiconductor light source apparatus.

The above-referenced Patent Documents are listed below and are hereby incorporated with their English abstracts in their entireties.

1. Patent document No. 1: Japanese Patent Application Laid Open JP2012-64484
2. Patent document No. 2: U.S. Pat. No. 8,556,437
3. Patent document No. 3: Japanese Patent Application Laid Open JP2013-130605

The disclosed subject matter has been devised to consider the above and other problems, characteristics and features. Thus, an embodiment of the disclosed subject matter can include semiconductor light source apparatuses, which can emit various color lights having high brightness and can efficiently radiate a heat, even when a high power semiconductor light source is used under a large current as a light source. In this case, an excited light emitted from a high power semiconductor light source can be efficiently wavelength-converted by a phosphor plate without a reduction of light intensity, because the phosphor plate is substantially located on a first reflector layer and does not include a substantially resin component.

In addition, a second reflector layer located under the first reflector layer can be constructed as a radiating layer to further improve a radiating efficiency and permanence of the phosphor plate even when the high power semiconductor light source is used under a large current. Thus, the semiconductor light source apparatuses can also emit the various color lights having high brightness from a light-emitting surface of the phosphor plate, and therefore can be employed for various lighting units such as general lighting, a stage light, a street light, a projector, etc.

SUMMARY

The presently disclosed subject matter has been devised in view of the above and other characteristics, desires, and problems in the conventional art. An aspect of the disclosed subject matter can provide reflective type semiconductor light source apparatuses, which can prevent a degradation of optical characteristics caused by heats generated from a phosphor plate and the like, and which can emit various color lights having high brightness including a substantially white color tone from a light-emitting surface of the phosphor plate in order to be able to be used for general lighting, a stage light, a street light, a projector, etc. Another aspect of the disclosed subject matter can provide the reflective type semiconductor light source apparatuses having a high reliability in addition to the above-described features, even when the high power semiconductor light source is used under a large current.

According to an aspect of the disclosed subject matter, a semiconductor light source apparatus can include: a phosphor plate formed in a substantially planar shape; a first reflector layer disposed underneath a part of a phosphor bottom surface of the phosphor plate, and including an exposed part from the part of the phosphor bottom surface, and therefore another part of the phosphor bottom surface being exposed from the first reflector layer; a contact layer including an adhesive material, contacting with the first reflector layer, and contacting with the other part of the phosphor bottom surface; a base board formed in a substantially planar shape; a second reflector layer formed on the base board, and contacting with the contact layer in an opposite direction of the first reflector layer; and a semiconductor light source being configured to emit an excited light, and located adjacent to the phosphor plate, an optical axis thereof intersecting with a phosphor top surface of the phosphor plate at an angle between 0 degrees and 90 degrees, and also contacting with the first reflector layer via the phosphor plate, and wherein the semiconductor light source apparatus is configured such that the excited light emitted from the semiconductor light source travelling along the optical axis changes direction toward the phosphor plate after being reflected from the first reflector layer.

In the above-described exemplary light source apparatus, the semiconductor light source apparatus further can include a first transparent protection layer being formed between the contact layer and the other part of the phosphor bottom surface, which is exposed from the first reflector layer, and the exposed part of the first reflector layer from the part of the phosphor bottom surface, and can also include a second transparent protection layer disposed on the second reflector layer, and a part of the second transparent protection layer contacting with the contact layer and the second reflector layer between the contact layer and the second reflector layer. Additionally, a semiconductor laser diode having a light-emitting wavelength of approximately 450 nanometers can be used as the semiconductor light source, and the YAG phosphor ceramic can be used as the phosphor plate.

According to the above-described exemplary semiconductor light source apparatuses, the semiconductor light source apparatus can be configured such that the excited light travelling along the optical axis changes direction toward the phosphor plate after being reflected from the first reflector layer, which transmits heats generated by the excited light toward the second reflector layer located under the first reflector layer. Therefore, the aspect of the disclosed subject matter can provide reflective type semiconductor light source apparatuses, which can prevent a degradation of optical characteristics caused by heats generated from the phosphor plate and the like, and which can emit various color lights having high brightness including a substantially white color tone from a light-emitting surface of the phosphor plate in order to be able to be used for general lighting, a stage light, a street light, a projector, etc.

According to another aspect of the disclosed subject matter, the semiconductor light source apparatus can include: another contact layer, with which the above-described contact layer 30 is replaced, the contact layer having a second contact layer and a first contact layer surrounded by the second contact layer, and being disposed between the phosphor plate and the second reflector layer, at least one of the first contact layer and the second contact layer including an adhesive material, wherein the first reflector layer is disposed between the first contact layer of the contact layer and the phosphor bottom surface of the phosphor plate and is surrounded by the second contact layer of the contact layer, and wherein a thermal conductivity of the first contact layer is higher than that of the second contact layer of the contact layer. In this case, the first contact layer of the contact layer can be formed by a substantially same material as the first reflector layer.

According to the above-described exemplary semiconductor light source apparatuses, a thermal conductivity from the phosphor plate to the second reflector layer via the first reflector layer and the first conductor layer, in which a relatively high heat transmits, can extremely improve. Accordingly, the second reflector layer located under the first reflector layer can be constructed as a radiating layer to further improve a radiating efficiency and permanence of the phosphor plate even when a high power semiconductor light source is used under a large current. Thus, the other aspect of the disclosed subject matter can provide the reflective type semiconductor light source apparatuses having a high reliability in addition to the above-described features, even when the high power semiconductor light source is used under a large current.

BRIEF DESCRIPTION OF THE DRAWINGS

These and other characteristics and features of the disclosed subject matter will become clear from the following description with reference to the accompanying drawings, wherein.

DETAILED DESCRIPTION OF EXEMPLARY EMBODIMENTS

Figure 1A:
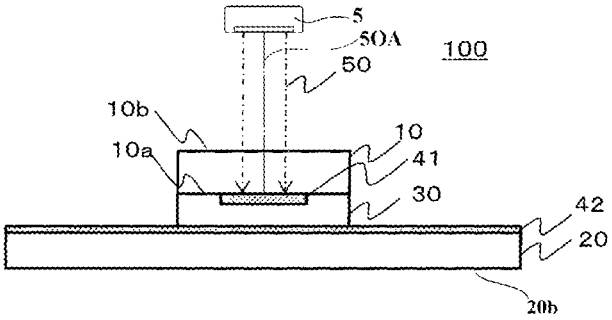
FIG. 1*a* is an explanatory structural front view showing a first exemplary embodiment of a semiconductor light source apparatus in accordance with principles of the disclosed subject matter.
Figure 1B:
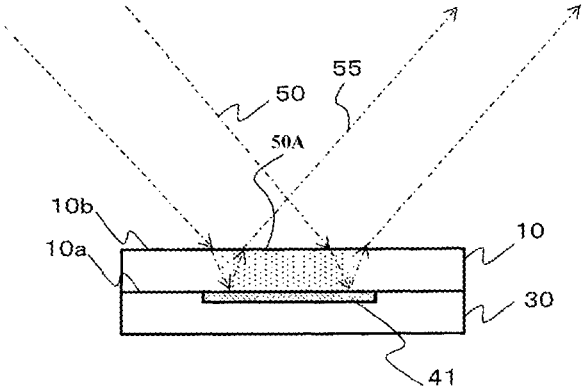
FIG. 1*b* is an explanatory structural side view to explain a wavelength-converting portion in the first embodiment of the semiconductor light source apparatus.

The disclosed subject matter will now be described in detail with reference to FIGS. 1*a* to 10*b*, in which the same or corresponding elements use the same reference marks. FIG. 1*a* is an explanatory structural front view showing a first exemplary embodiment of a semiconductor light source apparatus in accordance with principles of the disclosed subject matter, and FIG. 1*b* is an explanatory structural side view to explain a wavelength-converting portion in the first embodiment of the semiconductor light source apparatus.

A semiconductor light source apparatus 100 can include: a phosphor plate 10 having a phosphor bottom surface 10*a* and a phosphor top surface 10*b* formed in a substantially planar shape; a base board 20 formed in a substantially planar shape; a contact layer 30 including an adhesive material; a first reflector layer 41 disposed underneath a part of the phosphor bottom surface 10*a* of the phosphor plate 10, contacting with the part of the phosphor bottom surface 10*a*, and therefore another part of the phosphor bottom surface 10*a* of the phosphor plate 10 being exposed from the first reflector layer 41, and the first reflector layer 41 including an exposed part from the part of the phosphor bottom surface 10*a* of the phosphor plate 10, and wherein the contact layer 30 contacts with the other part of the phosphor bottom surface (10*a*) of the phosphor layer 30; and a second reflector layer 42 formed on the base board 20, and contacting the contact layer 30 in an opposite direction of the first reflector layer 41.

In addition, the semiconductor light source apparatus 100 can also include a semiconductor light source 5 having an optical axis 50A configured to emit an excited light 50 having a light-emitting wavelength from an ultraviolet light to a visible light, and the optical axis 5OA of the semiconductor light source 5 intersecting with the phosphor top surface (10*b*) of the phosphor plate (10) at an angle between 0 degrees and 90 degrees, and also intersecting with the first reflector layer 41 via the phosphor plate 10.

The semiconductor light source 5 can be located adjacent to the phosphor plate 10 so that the top surface 10*b* of the phosphor plate 10 can receive the exited light 50. Accordingly, the semiconductor light source apparatus 100 can be configured such that the excited light 50 emitted from the semiconductor light source 5 travelling along the optical axis 50A changes direction toward the phosphor plate (10) after being reflected from the first reflector layer 41, as shown in FIG. 1*b*.

As the semiconductor light source 5, an LED of GaN series that emits blue light having a light-emitting wavelength of approximately 450 nanometers can be used, and also a laser diode having a light-emitting wavelength of approximately 450 nanometers and a light-emitting intensity of 10 watts that emits blue light (e.g., a light-emitting area of 0.5 millimeters square) can be used. Additionally, an LED of InGaN series that emits near-ultraviolet light having a light-emitting wavelength of approximately 380 nanometers can also be used, and a laser diode that emits ultraviolet light can also be used as the semiconductor light source 5. As a light-intensity distribution, Gaussian distribution, top-hat distribution and variation distributions of the above-described distributions can be employed.

Cross-sectional shapes of the exited light 50 can be formed in various shapes such as a circle, an ellipsoidal shape, a rectangular shape, etc. Moreover, the semiconductor light source 5 can also include at least one of optical devices such as a lens, a mirror and the like to form the cross-sectional shapes of the exited light 50, the light-intensity distributions and the like so as to accommodate a client's needs.

The phosphor plate 10 can include at least one phosphor to wavelength-convert the exited light 50 emitted from the semiconductor light source 5 into light having a longer light-emitting wavelength than that of the light emitted from the semiconductor light source 5. The phosphor plate 10 may not include a substantial amount of resin component, and may include no resin component at all. Specifically, the substantial amount of the resin component for forming the phosphor plate 10 is, for example, 5 wt percentages or less in the phosphor plate 10.

The phosphor plate 10 can be made by dispersing a phosphor powder in a glass, and also a glass phosphor (e.g., oxynitride series glass phosphor such as Ca—Si—Al—O—N series, Y—Si—Al—O—N series, etc.) that adds a light-emitting ion into a glass including components such as phosphorus oxide ($P_2O_3$), silicon oxide ($SiO_2$), boron oxide ($B_2O_3$), aluminum oxide ($Al_2O_3$), etc. and a phosphor ceramic that is composed of a single crystal phosphor or a poly crystal phosphor can be used as the phosphor plate 10. The phosphor ceramic can be made by forming a phosphor in a predetermined shape and by burning the phosphor. In the case, even when an organic material is used as a binder in a manufacturing process for the phosphor plate 10, because the organic component is burnt in a degreasing process after the forming process, the phosphor ceramic can include only the resin component of 5 wt percentages or less.

As the phosphors, which are dispersing in the glass and are used from the phosphor ceramic, $CaAlSiN_3:Eu^{2+}$, (Ca, Sr) $AlSiN_3:Eu^{2+}$, $Ca_2Si_5N_8:Eu^{2+}$, (Ca, Sr)$_2$ $Si_5N_8:Eu^{2+}$, $KSiF_6:Mn^{4+}$, $KTiF_6:Mn^{4+}$ and the like can be used as a red phosphor of the phosphor plate 10. As a yellow phosphor for the phosphor plate 10, $Y_3Al_5O_{12}:Ce^{3+}$ (YAG), (Sr, Ba)$_2$ $SiO_4:Eu^{2+}$, $Ca_x$ (Si, Al)$_{12}$ (O, N)$_{16}:Eu^{2+}$ and the like can be used. As a green phosphor, (Si, Al)$_6$ (O, N)$_8:Eu^{2+}$, $BaMgAl_{10}O_{17}:Eu^{2+}$ $Mn^{2+}$, (Ba, Sr)$_2SiO_4:Eu^{2+}$, $Y_3$(Ga, Al)$_5O_{12}:Ce^{3+}$, $Ca_3Sc_2Si_3O_{12}:Ce^{3+}$, $CaSc_2O_4:Eu^{2+}$, $Ba_3Si_6O_{12}N_2:Eu^{2+}$ and the like can be used, and (Sr, Ca, Ba, Mg)$_{10}(PO_4)_6C_{12}:Eu^{2+}$, $BaMgAl_{10}O_{17}:Eu^{2+}$, LaAl (Si, Al)$_6$ (N, O)$_{10}:Ce^{3+}$ can be used as the blue phosphor.

As the phosphor ceramic of YAG for the phosphor plate 10, a YAG phosphor ceramic having a thickness of 0.2 millimeters can be used. In this case, at least one of silver layer (Ag) (e.g., a thickness of approximately 1,000 angstroms) and titanium (Ti) (e.g., a thickness of approximately 1,000 angstroms) can be formed on the YAG phosphor as the first reflector layer 41 having a size of 0.5 millimeters square. The YAG phosphor ceramic can be formed in a size of 1 millimeter square.

In addition, the phosphor plate 10 can include at least one of the above-described phosphors that wave-converts the exited light 50 emitted from the semiconductor light source 5 into light having a prescribed wavelength. For example, when the phosphor plate 10 includes the red phosphor wavelength-converting ultraviolet light into red light, the green phosphor wavelength-converting the ultraviolet light into green light and the blue phosphor wavelength-converting the ultraviolet light into blue light and when the semiconductor light source 5 emits the ultraviolet light, the semiconductor light source apparatus 100 can emit a mixture light 55 having a substantially white color tone by reflecting the mixture light 55 on the first reflector layer 41 due to an additive color mixture using lights excited by the three phosphors.

When the phosphor plate 10 includes the red phosphor wavelength-converting blue light into purple light and the green phosphor wavelength-converting the blue light into blue-green light and when the semiconductor light source 5 emits the blue light, the semiconductor light source apparatus 100 can also emit a mixture light 55 having a substantially white color tone by reflecting the mixture light 55 on the first reflector layer 41 due to an additive color mixture using lights excited by the two phosphors and a part of the blue light that is not excited by the phosphors.

Moreover, when the phosphor plate 10 includes a yellow phosphor wavelength-converting the blue light into yellow light and when the semiconductor light source 5 emits the blue light, the semiconductor light source apparatus 100 can emit a mixture light 55 having a substantially white light by reflecting the mixture light 55 on the first reflector layer 41 due to an additive color mixture using light excited by the yellow phosphor and a part of the blue light that is not excited by the yellow phosphor.

The base board 20 can operate as a fixing board to fix the phosphor plate 10, and also can operate as a radiator, which radiates a heat generated from the phosphor plate 10 as described with reference to FIG. 8 later. Accordingly, a metallic substrate such as aluminum, an oxide ceramic such as an alumina and a non oxide ceramic such as an aluminum nitride can be used as the radiating board because these materials have a high reflectivity, a high thermal conductivity and a high workability. Additionally, the base board 20 can be made from a metal such as Al, Cu, Ti, Ag, Au, Ni, Mo, W, Fe, Pd and the like and an alloy including at least one of the above-described metallic elements. The base board 20 can be provided with a fin on a bottom surface 20*b* thereof to improve the radiating efficiency.

The contact layer 30 can attach the phosphor plate 10 and the first reflector layer 41 thereon, and can include a material having a high thermal conductivity. Specifically, the organic adhesive material, the inorganic adhesive material and the low-melting-point glass can be used. More specifically, a silicone resin, an epoxy resin and the light having a high adhesive intensity and a high thermal conductivity. The first reflector layer 41 can include a material having a reflectivity so as to be able to efficiently reflect the mixture light 55. Accordingly, a metallic layer having the high reflectivity such as Al, Ti, Ag and the like and an alloy including at least one of the above-described metallic elements can be used as the first reflector layer 41.

Figure 2:
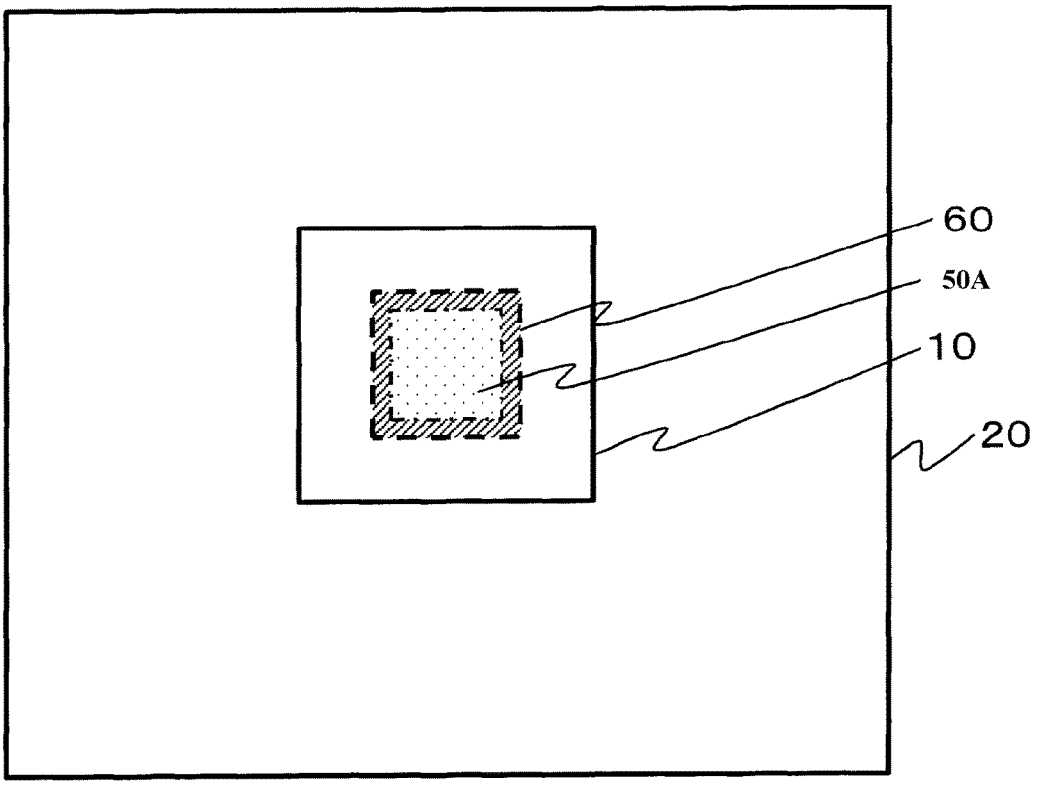
FIG. 2 is an enlarged top view showing the wavelength converting portion of the first embodiment shown in FIG. 1*b;*

A thickness of the first reflector layer 41 cannot be limited if the first reflector layer 41 has an enough thickness so as not to transmit the mixture light 55. Specifically, the thickness of the first reflector layer 41 can be between several nanometers and several dozen nanometers. FIG. 2 is an enlarged top view showing the wavelength converting portion of the first embodiment shown in FIG. 1*b*. The first reflector layer 41 is not necessarily formed underneath the whole bottom surface 10*a* of the phosphor plate 10, but can be formed under only a part of region 60 including an incident region 50A to receive the excited light 50 emitted from the semiconductor light source 5 on the top surface 10*b* of the phosphor plate 10.

Figure 3A:
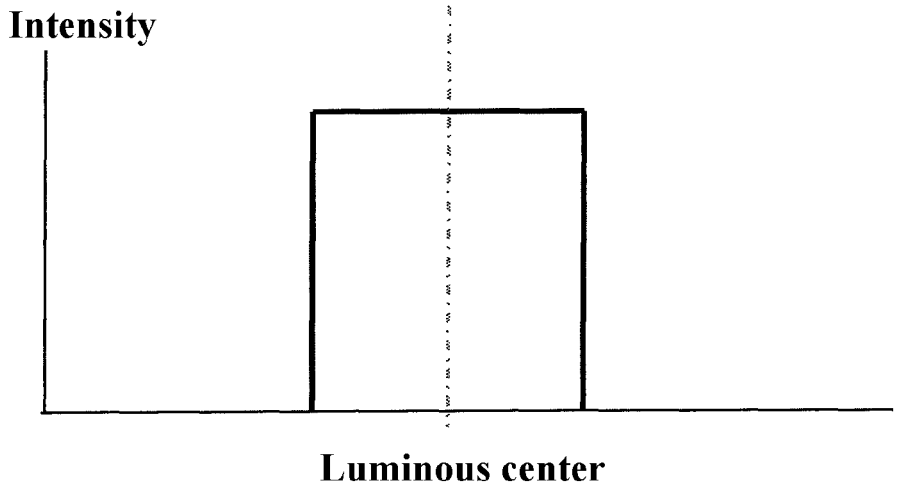
FIGS. 3*a* and 3*b* are graphs showing two-dimensional light-intensity distributions including an optical axis on an incident surface of a phosphor plate shown in FIG. 2, when the excited light having top-hat distribution is emitted on the incident surface and when the excited light having Gaussian distribution is emitted on the incident surface, respectively.
Figure 3B:
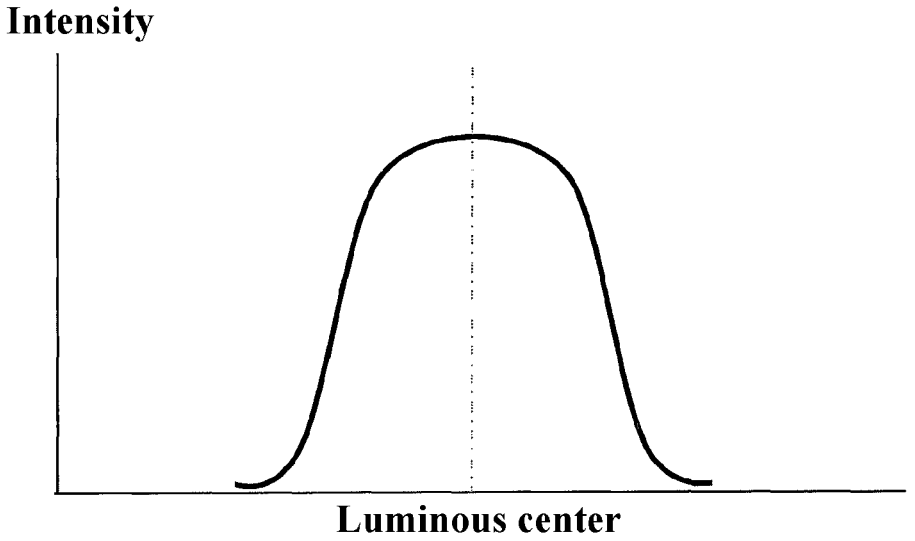

FIGS. 3*a* and 3*b* are graphs showing two-dimensional light-intensity distributions including the optical axis 50A on the incident surface 50A of the phosphor plate 10 shown in FIG. 2, when the excited light 50 having top-hat distribution is emitted on the incident surface 50A and when the excited light 50 having Gaussian distribution is emitted on the incident surface 50A, respectively. Each of luminous centers corresponds to an incident point on the incident surface 50A of the optical axis 50A of the semiconductor light source 5.

When the excited light 50 having top-hat distribution is emitted on the incident surface 50A on the top surface 10*b* of the phosphor plate 10, a boundary between the incident surface 50A and an out of range of the incident surface 50A can become sharp. When the excited light 50 having Gaussian distribution is emitted on the incident surface 50A on the top surface 10*b* of the phosphor plate 10, because the boundary between the incident surface 50A and an out of range of the incident surface 50A can become gentle, each of the excited light 50 having top-hat distribution and the excited light 50 having Gaussian distribution can be employed in accordance with a usage of the semiconductor light source apparatus 100.

Therefore, the disclosed subject matter can include semiconductor light source apparatuses, which can emit various color lights having high brightness and can efficiently radiate the above-described heats generated from the phosphor plate 10 and the first reflector 41 without a reduction of light intensity. Next, an exemplary method for manufacturing the semiconductor light source apparatus 100 of the disclosed subject matter will now be described with reference to FIG. 4 to FIG. 7.

Figures 4A, 4B:
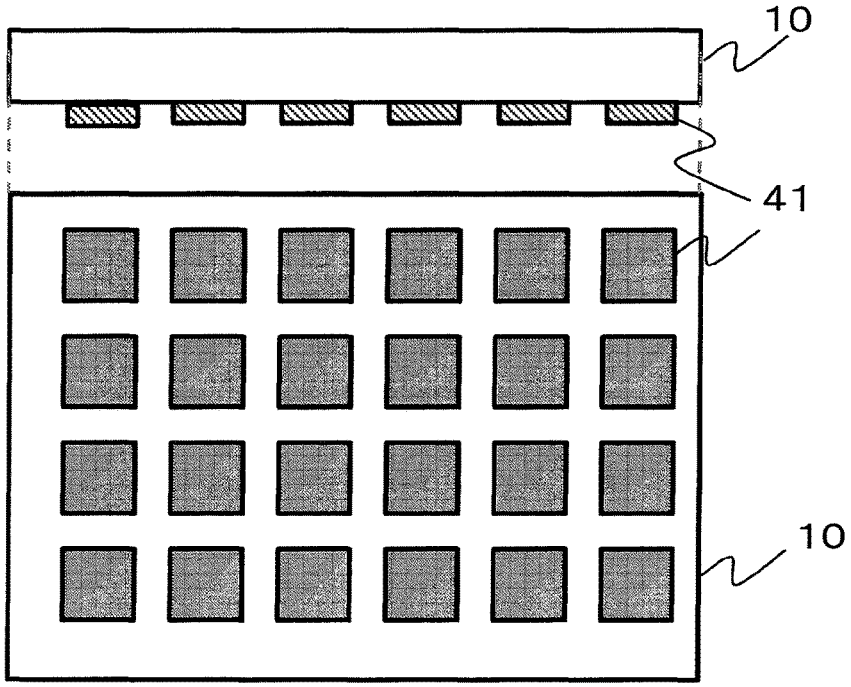
FIGS. 4*a* and 4*b* are an enlarged front view and an enlarged top view showing an exemplary process (a) for forming a plurality of first reflector layers on a large phosphor plate, respectively.

Process (a) is preparing a large phosphor plate, which is made by sinter the phosphor, and pattern-forming a plurality of first reflector layers on the large phosphor plate by a metal mask method, a photolithography process, etc. as shown in FIGS. 4*a* and 4*b*, which are an enlarged front view and an enlarged top view showing an exemplary process (a) for forming the first reflector layers on the large phosphor plate, respectively.

Figures 5A, 5B:
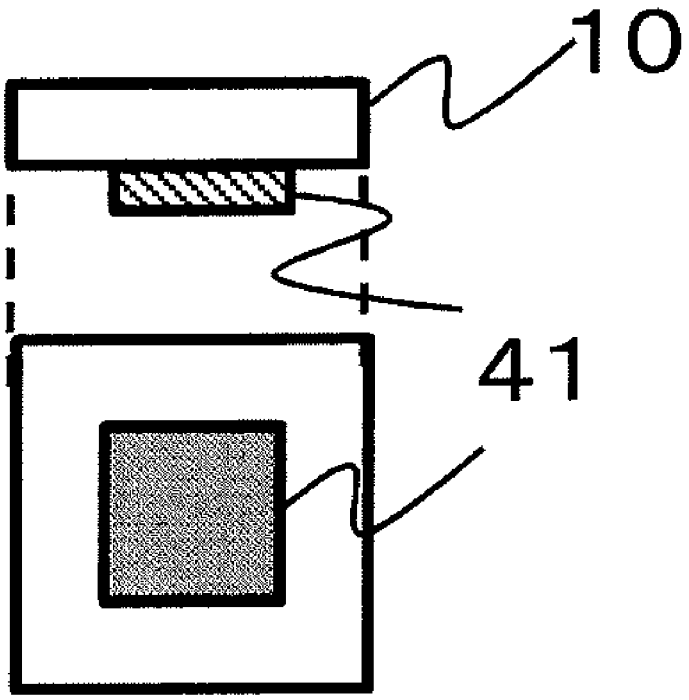
FIGS. 5*a* and 5*b* are an enlarged front view and an enlarged top view showing an exemplary process (b) for singulating the large phosphor plate manufactured in the process (a), respectively.

Process (b) is dividing the large phosphor plate forming the plurality of first reflector layers into an individual the phosphor plate, as shown in FIGS. 5*a* and 5*b*, which are an enlarged front view and an enlarged top view showing an exemplary process (b) for singulating the large phosphor plate manufactured in the process (a), respectively.

Figure 6:
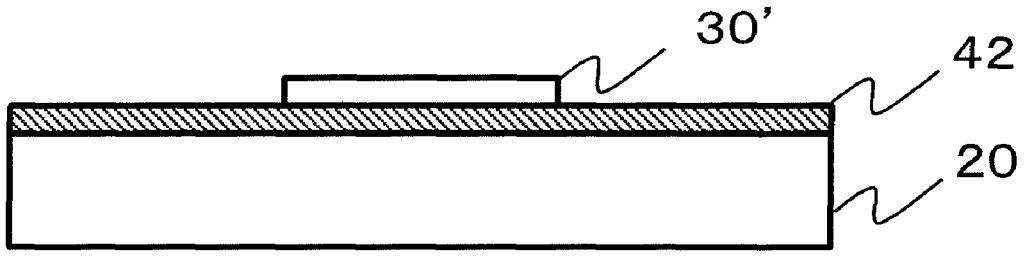
FIG. 6 is an enlarged front view showing a base board including a second reflector layer, which disposes an uncured transparent resin thereon.

Process (c) is preparing the base board 20 forming the second reflector layer 42 on thereon, and disposing an uncured transparent resin 30' on a middle portion of the second reflector 42, as show in FIG. 6, which is an enlarged front view showing the base board 20 including the second reflector layer 42, which disposes the uncured transparent resin 30' thereon.

Figure 7:
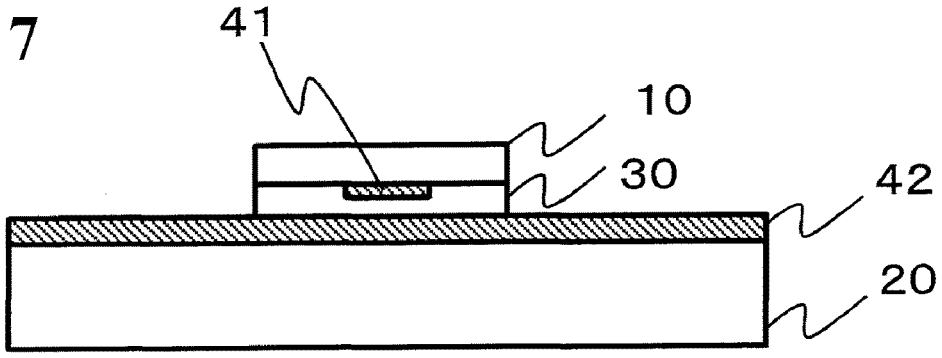
FIG. 7 is an enlarged front view showing a wavelength converting portion including a phosphor plate.

Process (d) is disposing the phosphor plate 10 manufactured in process (b) on the base board 20 manufactured in process (c), solidifying the uncured transparent 30' and finishing the wavelength converting portion, as shown in FIG. 7, which is an enlarged front view showing the wavelength converting portion.

Here, a radiating effect of the semiconductor light-emitting apparatus 100 will now be described with reference to FIG. 8. Many of the heat generated from the phosphor plate 10 by the excited light 50 emitted from the semiconductor light source 5 can radiate directly from the phosphor plate because surfaces except for the bottom surface 10*a* of the phosphor plate 10 are exposed from the contact layer 30. Additionally, a heat directed toward the bottom surface 10*a* of the phosphor plate 10 can be absorbed into the first reflector layer 41 along with a heat, which is absorbed into the first reflector 41 without a reflection on the first reflector layer 41.

Figure 8:
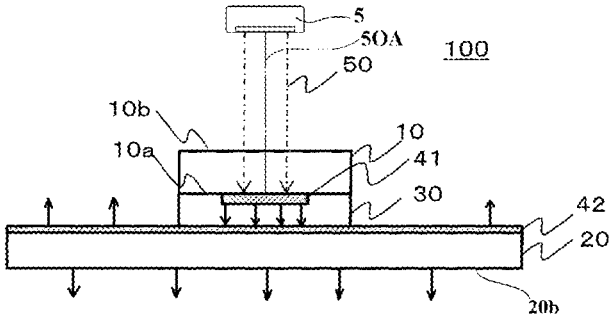
FIG. 8 is an explanatory front view to explain a radiating effect in the first embodiment of the semiconductor light source apparatus shown in FIG. 1*a;*

However, the above-described heats absorbed into the first reflector layer 41 can be directed toward the second reflector layer 42, and can be transmitted from the first reflector layer 41 toward the second reflector layer 42 via the contact layer 30 having a high thermal conductivity as shown by arrows in FIG. 8. Accordingly, in the semiconductor light-emitting apparatus 100 of the disclosed subject matter, the heats can efficiently radiate from the second reflector layer 42 and the base board having a high thermal conductivity, and therefore can prevent the degradation of optical characteristics such that may be caused in conventional semiconductor light source apparatuses.

Figure 9A:
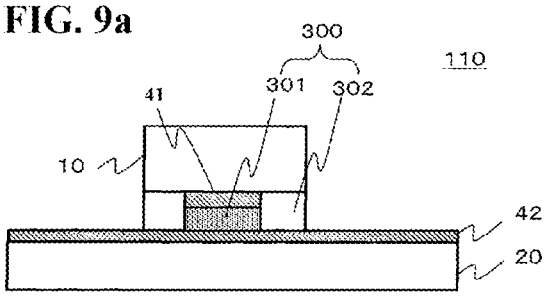
FIG. 9*a* is an explanatory structural front view showing a second exemplary embodiment of the semiconductor light source apparatus in accordance with principles of the disclosed subject matter.

Second exemplary embodiments of the semiconductor light-emitting apparatus will now be described with reference to FIG. 9*a* and FIG. 9*b*, which do not show the semiconductor light source 5 to facilitate an understanding of the second embodiment. Differences between the second embodiment and the above-described first embodiment relate to another contact layer 300, with which the contact layer 30 of the first embodiment is replaced. Accordingly, the contact layer 300 and elements associated with the contact layer 300 will now be described here, because other structures of the second embodiment is a substantially same as the first embodiment.

The semiconductor light-emitting apparatus 110 of the second embodiment can include the contact layer 300 including a first contact layer 301 and a second contact layer 302, and the contact layer 300 can be disposed between the phosphor plate 10 and the second reflector layer 42 along with the first reflector layer 41, which is disposed between the first contact layer 301 and the phosphor plate 10 and which is surrounded by the second contact layer 302. A thermal conductivity of the first contact layer 301 can be higher than that of the second contact layer 302 of the contact layer 300, and at least one of the first contact layer 301 and the second contact layer 302 can include an adhesive material Therefore, each of the first reflector layer 41 and the second contact layer 302 can contact with the phosphor plate 10, and also each of the first contact layer 301 and the second contact layer 302 can contact with the second reflector layer 42 by using the adhesive effect of the contact layer 300. The first reflector layer 41 can also contact with the first contact layer 301 by using the adhesive effect of the contact layer 300. Additionally, the second contact layer 302 can also contact with the first reflector layer 41 and the first contact layer 301. The second contact layer 302 can be composed of a substantially same material as the conduct layer 30 of the first embodiment such as a silicon adhesive material having a high thermal conductivity, etc.

However, the first contact layer 301 can be configured with a material having a high thermal conductivity such as a silicone adhesive material having a high thermal conductivity including metallic filler such as a silver, etc. A thermal conductivity of the silicone adhesive material is approximately 0.1 W/m K, however, a thermal conductivity of the silicone adhesive material including the metallic filler of the silver can become approximately 6.4 to 6.8 W/m K. Therefore, a thermal conductivity from the phosphor plate 10 to the second reflector layer 42 via the first reflector layer 41 and the first conductor layer 301, in which a relatively high heat transmits, can extremely improve. Accordingly, the second reflector layer 42 located under the first reflector layer 41 can be constructed as a radiating layer to further improve a radiating efficiency and permanence of the phosphor plate 10 even when a high power semiconductor light source 5 is used under a large current.

Figure 9B:
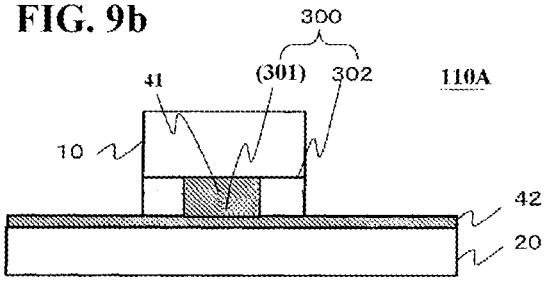
FIG. 9*b* is an explanatory structural front view showing an exemplary variation of the second embodiment of the semiconductor light source apparatus.

As an exemplary variation of the second embodiment as shown in FIG. 9*b*, the first contact layer 301 can be formed by a substantially same material as the first reflector layer 41 such as the metallic layer having a high reflectivity as described in the first embodiment. Thereby, a manufacturing process for the semiconductor light-emitting apparatus 110A can improve in addition to an improvement of the thermal conductivity between the phosphor plate 10 and the second reflector layer 42.

As described above, the semiconductor light-emitting apparatuses 110 and 110A of the second embodiment can also emit the mixture light having various color tones and a high light-intensity, and also can prevent the degradation of optical characteristics such that may be caused in the conventional semiconductor light-emitting apparatuses. Therefore, the disclosed subject matter can provide the semiconductor light source apparatuses, which can also emit the various color lights having high brightness from the light-emitting surface of the phosphor plate 10, even when the high power semiconductor light source is used under a large current.

Figure 10A:
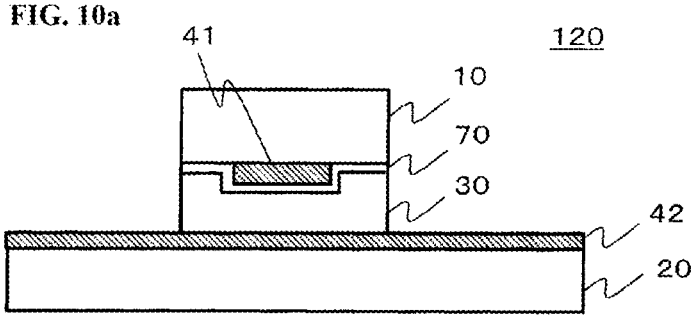
FIG. 10*a* is an explanatory structural front view showing an third exemplary embodiment of the semiconductor light source apparatus in accordance with principles of the disclosed subject matter.

Next, third exemplary embodiments of the semiconductor light-emitting apparatus will now be described with reference to FIGS. 10*a* and 10*b*, which do not show the semiconductor light source 5 to facilitate an understanding of the third embodiment. Differences between the third embodiment and the above-described first embodiment relate to a first transparent protection layer 70, which surrounds the first reflector layer 41. Because other structures of the third embodiment is a substantially same as the first embodiment, the first transparent protection layer 70 and elements associated with the first transparent protection layer 70 will now be described here.

The semiconductor light-emitting apparatus 120 can include the first transparent protection layer 70 between the contact layer 30 and the phosphor plate 10 and the exposed part of the first reflector layer 41, which does not contact with the phosphor plate 10. The first transparent protection layer 70 can be composed of a transparent ceramic material such as aluminum oxide ($Al_2O_3$) and the like, amorphous materials, etc. After the above-described process (b), the transparent ceramic material can be formed on the phosphor plate 10 including the first reflector layer 41, and then the semiconductor light-emitting apparatus 120 can be manufactured by the processes (c) and (d). A thickness of the first transparent protection layer 70 can be approximately 1 to 1,000 nanometers.

Figure 10B:
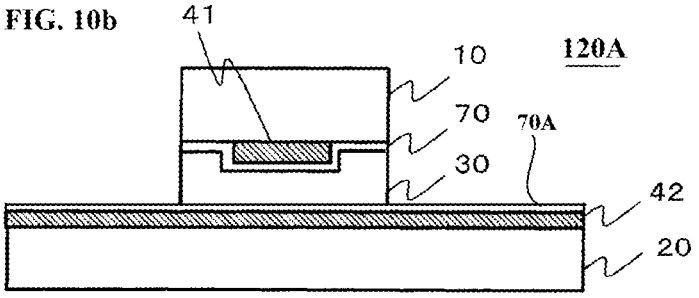
FIG. 10*b* is an explanatory structural front view showing an exemplary variation of the third embodiment of the semiconductor light source apparatus.
Figure 11:
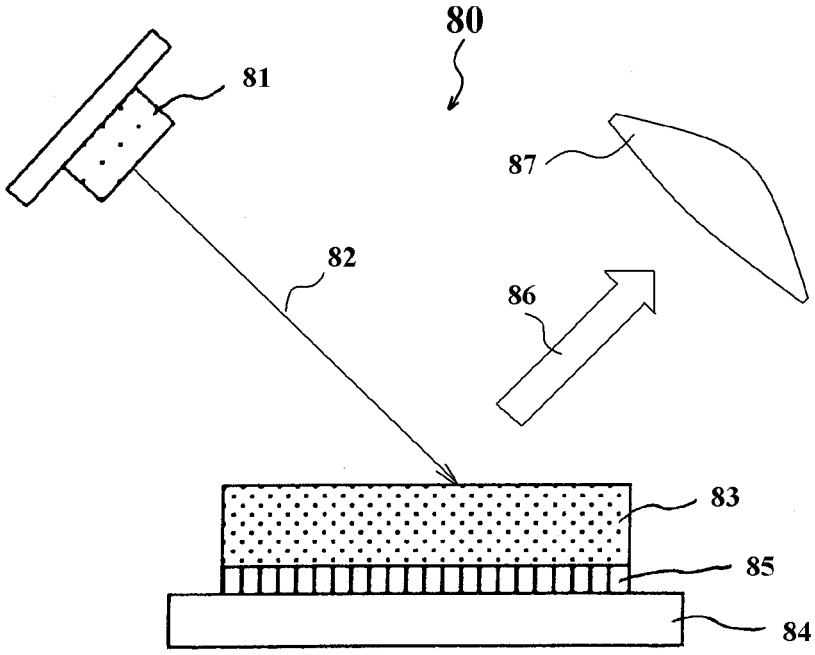
FIG.11 Conventional Art
FIG. 11 is a schematic structural view showing a first conventional semiconductor light source apparatus.

As an exemplary variation of the third embodiment as shown in FIG. 10*b*, the semiconductor light-emitting apparatus 120A can further include a second transparent protection layer 70A, which is a substantially same layer as the first transparent protection layer 70, on the second reflector layer 42, so that a part of the second transparent protection layer 70A can be contact with the contact layer 30 and the second reflector layer 42. Thereby, each of the first and the second transparent protection layer 70 and 70A can prevent each of the first and the second reflector layers 41 and 42 from a degradation of reflective characteristics, which may be caused by a migration behavior, respectively.

Thus, the disclosed subject matter can provide reliable semiconductor light source apparatuses having the phosphor plate 10 and the first and the second reflector layers 41 and 42, which can prevent a degradation of optical characteristics caused by the heats generated from the phosphor pale 10 and the first reflector layer 41 and can efficiently radiate the heats using the second reflector layer 42 and the like, and which can also emit various color lights having a large amount of light intensity including a substantially white color tone in order to be able to be used for general lighting, a stage light, a street light, a projector, etc.

Various modifications of the above disclosed embodiments can be made without departing from the spirit and scope of the presently disclosed subject matter. For example, the second transparent protection layer 70A can be formed in the second reflector layer 42 in the second embodiment of the disclosed subject matter as shown in FIG. 9*a* and FIG. 9*b*. In addition, the specific arrangement between components can vary between different applications, and several of the above-described features can be used interchangeably between various embodiments depending on a particular application of the device.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A semiconductor light source apparatus, comprising:

a phosphor plate having a phosphor bottom surface and a phosphor top surface formed in a substantially planar shape;

a first reflector layer disposed underneath a part of the phosphor bottom surface of the phosphor plate, and including an exposed part from the part of the phosphor bottom surface of the phosphor plate, and therefore another part of the phosphor bottom surface of the phosphor plate being exposed from the first reflector layer;

a contact layer including an adhesive material, contacting with the first reflector layer, and contacting with the other part of the phosphor bottom surface of the phosphor plate;

a base board formed in a substantially planar shape;

a second reflector layer formed on the base board, and contacting with the contact layer in an opposite direction of the first reflector layer; and a semiconductor light source having an optical axis being configured to emit an excited light having a light-emitting wavelength from an ultraviolet light to a visible light, and located adjacent to the phosphor plate, the optical axis of the semiconductor light source intersecting with the phosphor top surface of the phosphor plate at an angle between 0 degrees and 90 degrees, and also contacting with the first reflector layer via the phosphor plate, and wherein the semiconductor light source apparatus is configured such that the excited light emitted from the semiconductor light source travelling along the optical axis changes direction toward the phosphor plate after being reflected from the first reflector layer.

2. The semiconductor light source apparatus according to claim 1, further comprising:

a first transparent protection layer being formed between the contact layer and the other part of the phosphor bottom surface of the phosphor plate, which is exposed from the first reflector layer, and the exposed part of the first reflector layer from the part of the phosphor bottom surface of the phosphor plate.

3. The semiconductor light source apparatus according to claim 1, further comprising:

a second transparent protection layer disposed on the second reflector layer, and a part of the second transparent protection layer contacting with the contact layer and the second reflector layer between the contact layer and the second reflector layer.

4. The semiconductor light source apparatus according to claim 1, wherein a semiconductor laser diode having a light-emitting wavelength of approximately 450 nanometers is used as the semiconductor light source, and the YAG phosphor ceramic is used as the phosphor plate.

5. The semiconductor light source apparatus according to claim 2, further comprising:

a second transparent protection layer disposed on the second reflector layer, and a part of the second transparent protection layer contacting with the contact layer and the second reflector layer between the contact layer and the second reflector layer.

6. A semiconductor light source apparatus, comprising:

a phosphor plate having a phosphor bottom surface and a phosphor top surface formed in a substantially planar shape;

a first reflector layer disposed underneath a part of the phosphor bottom surface of the phosphor plate, and including an exposed part from the part of the phosphor bottom surface of the phosphor plate, and therefore another part of the phosphor bottom surface of the phosphor plate being exposed from the first reflector layer;

a contact layer having a second contact layer and a first contact layer surrounded by the second contact layer, and being disposed between the phosphor plate and the second reflector layer, at least one of the first contact layer and the second contact layer including an adhesive material, wherein the first reflector layer is disposed between the first contact layer of the contact layer and the phosphor bottom surface of the phosphor plate and is surrounded by the second contact layer of the contact layer, and wherein a thermal conductivity of the first contact layer is higher than that of the second contact layer of the contact layer;

a base board formed in a substantially planar shape;

a second reflector layer formed on the base board, and contacting with the first contact layer and the second contact layer of the contact layer in an opposite direction of the first reflector layer; and a semiconductor light source having an optical axis being configured to emit an excited light having a light-emitting wavelength from an ultraviolet light to a visible light, and located adjacent to the phosphor plate, the optical axis of the semiconductor light source intersecting with the phosphor top surface of the phosphor plate at an angle between 0 degrees and 90 degrees, and also contacting with the first reflector layer via the phosphor plate, and wherein the semiconductor light source apparatus is configured such that the excited light emitted from the semiconductor light source travelling along the optical axis changes direction toward the phosphor plate after being reflected from the first reflector layer.

7. The semiconductor light source apparatus according to claim 6, wherein the first contact layer of the contact layer is formed by a substantially same material as the first reflector layer.

8. The semiconductor light source apparatus according to claim 6, further comprising:

a second transparent protection layer disposed on the second reflector layer, and a part of the second transparent protection layer contacting with the second reflector layer and the first contact layer and the second contact layer of the contact layer between the contact layer and the second reflector layer.

9. The semiconductor light source apparatus according to claim 6, wherein a semiconductor laser diode having a light-emitting wavelength of approximately 450 nanometers is used as the semiconductor light source, and the YAG phosphor ceramic is used as the phosphor plate.

10. The semiconductor light source apparatus according to claim 7, further comprising:

a second transparent protection layer disposed on the second reflector layer, and a part of the second transparent protection layer contacting with the second reflector layer and the first contact layer and the second contact layer of the contact layer between the contact layer and the second reflector layer.

* * * * *